United States Patent [19]

Stein, Sr. et al.

[11] Patent Number: 4,832,616

[45] Date of Patent: May 23, 1989

[54] ELECTRICAL CONNECTOR WITH CONDUCTOR SEAL LOCK

[75] Inventors: William L. Stein, Sr., Warren; Hoi Lui, Cortland, both of Ohio

[73] Assignee: General Motors Corporation, Detroit, Mich.

[21] Appl. No.: 395,481

[22] Filed: Jul. 6, 1982

[51] Int. Cl.[4] ..... H01R 13/52

[52] U.S. Cl. ..... 439/279; 439/281; 439/587

[58] Field of Search ..... 339/59–61; 439/587, 281, 279

[56] References Cited

U.S. PATENT DOCUMENTS

| | | | |
|---|---|---|---|
| Re. 28,147 | 9/1974 | Hoffman | 339/59 M |
| 3,165,369 | 1/1965 | Maston | 339/206 R |
| 3,173,736 | 3/1965 | Brinkel et al. | 339/60 R |
| 3,602,874 | 8/1971 | Sarazen | 339/210 M |
| 4,045,110 | 8/1977 | Sterken | 339/91 R |
| 4,066,325 | 1/1978 | Pearce, Jr. et al. | 339/176 MP |
| 4,116,521 | 9/1978 | Herrmann, Jr. | 339/60 R |
| 4,173,349 | 11/1979 | Neale, III | 339/60 C |
| 4,225,206 | 9/1980 | Roman, Jr. | 339/91 R |

*Primary Examiner*—John McQuade
*Assistant Examiner*—Paula A. Austin
*Attorney, Agent, or Firm*—F. J. Fodale

[57] ABSTRACT

An electrical connector comprises a connector body having a plurality of longitudinal cavities which include rearward sealing portions, terminals disposed in the cavities and attached to conductors which extend out of the rearward sealing portions of the cavities and elastomeric seal sleeves for sealing the conductor end of the electrical connector. A conductor seal lock attached to the conductor end of the connector body has towers coaxially disposed on the conductors and axially compressing the elastomeric seal sleeves to ensure full insertion of the terminals and the accurate positioning of the terminals in the cavities.

3 Claims, 1 Drawing Sheet

ELECTRICAL CONNECTOR WITH CONDUCTOR SEAL LOCK

This invention relates generally to electrical connectors and, more particularly, to electrical connectors for wiring harnesses having elastomeric conductor seals and a lock acting on the elastomeric conductor seals to prevent withdrawal of the terminals attached to the ends of the conductors.

U.S. Pat. No. 4,225,206 granted to Michael J. Roman on Sept. 30, 1980 discloses an electrical connector of the above noted type. This prior art electrical connector comprises a dielectric connector body 12 having a plurality of terminal cavities 22*a*, 22*b*. A terminal 14, which is attached to the end of a conductor 32, is inserted into each cavity and retained therein by a lock tab 28*e*. An elastomeric seal sleeve 30 secured around the end of the conductor 30 by the terminal 14 seals the open end of the cavity. The connector body 12 has a flap 34 which when closed cooperates with the ends of the elastomeric seal sleeves 30 to provide a second or redundant lock which prevents the terminals 14 from being pulled out of the cavities 22*a*, 22*b* by the conductors 32.

While the conductor seal lock exemplified by the aforesaid patent is suitable for many purposes, we have found that in some cases the flap can be closed when the terminal are not fully inserted in the terminal cavities and that in other cases the closed flap permits significant longitudinal movement of the terminals in the terminal cavities.

The object of this invention is to provide a conductor seal lock which ensures full insertion of the terminals and a precise location of the terminals in the terminal cavities.

A feature of the invention is that the conductor seal lock applies a significant axial force to the elastomeric seal sleeves adjacent the conductors for driving the terminals to fully inserted positions in the terminal cavities.

Another feature of the invention is that the conductor seal lock compresses the elastomeric seal sleeves axially for accurately positioning the terminals in the terminal cavities. The axial compression also improves the sealing at the radially confining walls of the connector body.

Yet another feature of the invention is that the conductor seal lock is easily assembled to the conductors and guided into position with the connector body by the conductors.

Other objects and features of the invention will become apparent to those skilled in the art as the disclosure is made in the following detailed description of a preferred embodiment of the invention as illustrated in the accompanying sheet of drawing in which.

Figure 1:
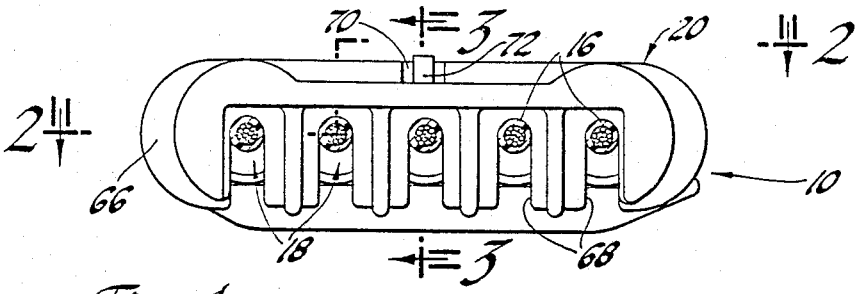
FIG. 1 is an end view of an electrical connector in accordance with this invention.
Figure 2:
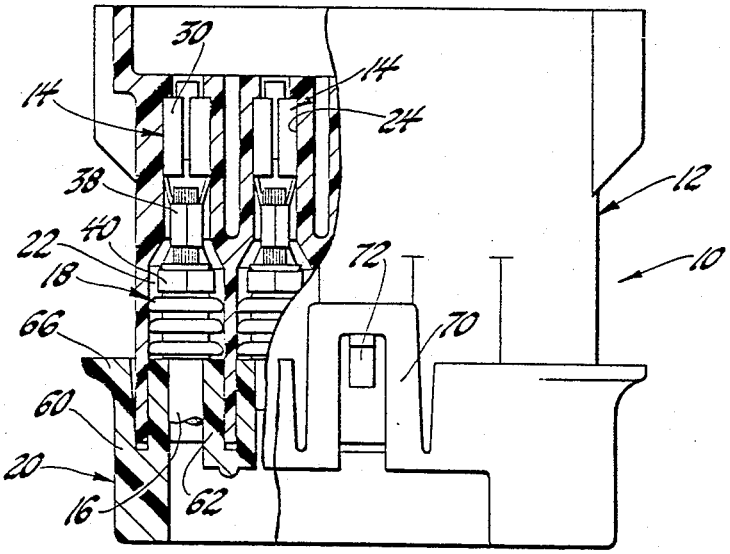
FIG. 2 is a partially sectioned top view of the electrical connector taken substantially along the line 2—2 of FIG. 1 looking in the direction of the arrows.
Figure 3:
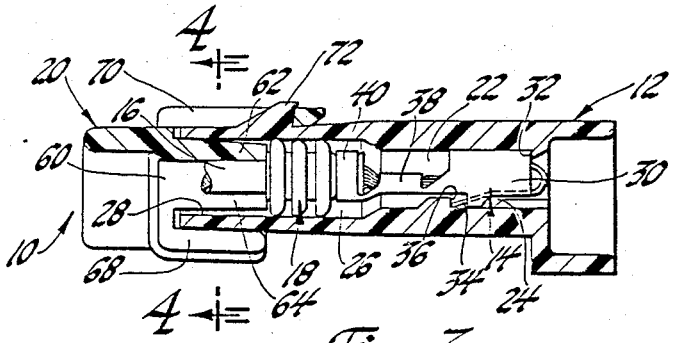
FIG. 3 is a longitudinal section of the electrical connector taken substantially along the line 3—3 of FIG. 1 looking in the direction of the arrows.
Figure 4:
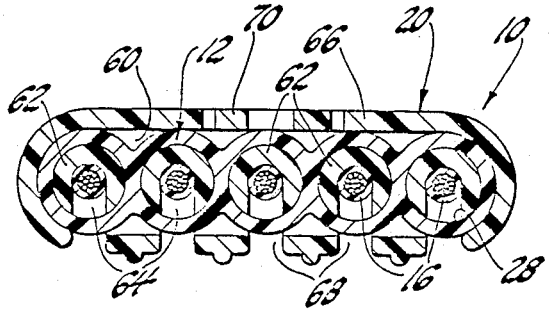
FIG. 4 is a section taken substantially along the line 4—4 of FIG. 3 looking in the direction of the arrows.

Referring now to the drawing, the electrical connector 10 comprises a dielectric connector body 12, a plurality of terminals 14 attached to the ends of conductors 16, a plurality of elastomeric seal sleeves 18 secured to the ends of the conductors 16 by the terminals 14, and a conductor seal lock 20.

The connector body 12 has a plurality of longitudinal cavities 22 comprising forward contact sections 24 and rearward seal sections 26 defined by enlarged cylindrical walls 28.

The terminals 14 are individually attached to the ends of the conductors 16 and comprise forward contact portions 30 which are disposed in contact sections 24 of the cavities 22 against forward shoulders 32. The terminals 14 have lock tabs 34 which engage medial shoulders 36 to retain the terminals 14 in the cavities 22.

Figure 5:
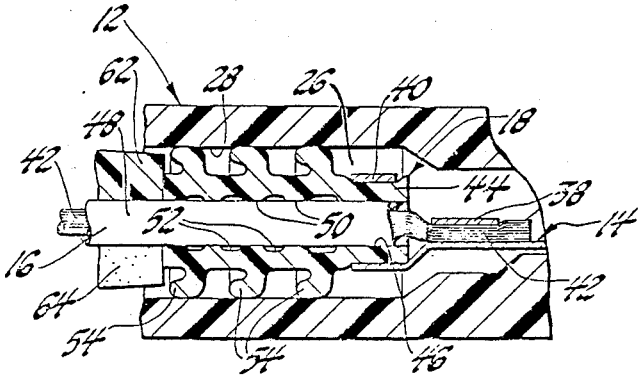
FIG. 5 is an enlarged view of a portion of FIG. 3.

Referring now to FIG. 5, each terminal 14 has two pairs of crimp wings 38 and 40. Crimp wings 38 are tightly crimped on the exposed end of the conductor core 42 to secure the terminal 14 to the conductor 16. Crimp wings 40 are tightly crimped around the seal sleeve 18 which is premolded from an elastomeric material such as silicone rubber and assembled to the end of the conductor 16. The forward portion 44 of the seal sleeve 18 preferably has a uniform thickness and a smooth bore 46 which when molded has a slightly larger diameter than the outer diameter of the conductor insulation 48. The rear portion of the seal sleeve 18 has a corrugated bore defined by a plurality of circular ribs 50 having a minimum diameter less than that of the outer diameter of the conductor insulation 48. The grooves 52 between the ribs 50 preferably have a maximum diameter which is the same as that of smooth bore 46 of the forward portion. The grooves 52 provide migration space for the ribs 50 which have an interference fit with the conductor insulation 48 and reduce insertion forces required for assembly.

The rearward portion of the sleeve 18 also has three radially extending flexible circular lips 54 which sealingly engage the cylindrical wall 28 defining each rearward seal section 26 of the cavities 22.

The terminal 14, conductor 16 and seal sleeve 18 are assembled by inserting an end of the conductor 16 into the rearward end of seal sleeve 18 until it protrudes from the forward end of the seal sleeve 18 a little more than the length of the crimp wings 38. The insulation 48 is then stripped away exposing the end of the conductor core 42. The terminal 14 is then attached to the conductor 16 by crimping the crimp wings 38 tightly around the exposed end of the conductor core 42 and the crimp wings 40 tightly about the forward end 44 of the seal sleeve 18 which squeezes the forward end 44 into tight sealing engagement with the insulation 48. Both pairs of crimp wings contribute to securing the seal sleeve 18 and the terminal 14 to the conductor 16.

The terminals 14 are inserted into the cavities 22 through the open ends of the rearward seal sections 26 until the contact portions 30 are retained in the contact sections 24 by the shoulders 32 and 36 as indicated above.

The conductor seal lock 20 is then assembled to the conductor body 12.

The conductor seal lock 20 comprises a base 60 having a plurality of longitudinally extending towers 62. The towers 62 correspond in number to the cavities 22 and are spaced apart so that one of the towers 62 enters each of the rearward sealing sections 26 of the cavities 22 when the lock 20 is attached to the connector body 12. The towers 62 are cylindrical and have a diameter which is a few thousands of an inch less than the diameter of the cylindrical walls 28. Each tower 62 has a longitudinal slot 64 which also extends through the base 60 so that the conductors 16 can be laterally inserted into the towers 62. The slots 64 are sized so that one of the conductors 16 is disposed in each of the towers 62 in substantially coaxial relationship to its associated tower.

The conductor seal lock 20 also has an annular shroud 66 which is radially spaced from the towers 62 so that the conductor end of the connector body 12 fits snuggly between the towers 62 and the shroud 66 when the conductor seal lock 20 is attached. This stabilizes the attachment and prevents any substantial rocking movement of the conductor seal lock 20 with respect to the connector body 12.

The shroud 66 has several longitudinal slots 68 aligned with the tower slots 64, respectively, so that the conductors 16 can be passed through the shroud 66 laterally and laterally inserted into the towers 62. The conductor seal lock 20 also has a lock arm 70 which is formed out of the shroud 66 and which cooperates with the nib 72 of the connector body 12 to retain the conductor seal lock 20 attached to the connector body 12.

The conductor seal lock 20 is assembled to the connector body 12 by setting the conductor seal lock 20 on top of the conductors 16 a short distance behind the connector body 12 so that the conductors 16 are laterally received in the towers 62 via the slots 64 and 68. The conductor seal lock 20 is then slid along the conductors 16 which guide the towers 62 into the open ends of the cavities 22 as the conductor seal lock is assembled to the connector body 12 and locked in place by the lock arm 70 and the nib 72 as indicated above. During assembly, the seal sleeves 18 of any terminals 14 which are not fully inserted will be engaged by the associated tower 62 and such terminals will be driven to the fully inserted position by substantially axial forces applied to the column-like seal sleeves 18. When the seal sleeve lock 20 is locked in place, the towers 62 are dimensioned so that the seal sleeves 18 are compressed slightly in the axial or longitudinal direction. This axial compression is sufficient to eliminate any longitudinal play of the terminals 14 in the cavities 22 and also locates the terminals 14 accurately in the cavities 22 against the shoulders 32. The axial compression of the seal sleeves 18 also tends to expand the seal sleeves 18 radially and improve the sealing of the flexible circular lips 54 against the radially confining cylindrical walls 28.

Thus, it can be seen that we have provided an easily assembled conductor seal lock which ensures full terminal insertion, accurate positions of the terminals in the connector body cavities and tends to improve sealing at the conductor end of the connector.

We wish it to be understood that we do not desire to be limited to the exact details of construction shown and described, for obvious modifications will occur to a person skilled in the art.

The embodiments of the invention in which an exclusive property of privilege is claimed are defined as follows:

1. An electrical connector comprising:

a connector body having a plurality of longitudinal cavities which include rearward sealing portions having cylindrical walls, terminals disposed in the cavities and attached to conductors which extend out of the rearward sealing portions of the cavities, seal sleeves sealingly engaging the conductors and the cylindrical walls for sealing the conductor end of the electrical connector, and a conductor seal lock attached to the connector body, said conductor seal lock having towers coaxially disposed on the conductors and axially compressing the seal sleeves to force the terminals against forward shoulders in the cavities.

2. An electrical connector comprising:

a connector body having a plurality of longitudinal cavities which include rearward sealing portions having cylindrical walls, terminals disposed in the cavities and attached to conductors which extend out of the rearward sealing portions of the cavitites, seal sleeves sealingly engaging the conductors and the cylindrical walls for sealing the conductor end of the electrical connector, and a conductor seal lock attached to the connector body, said conductor seal lock having a base and a plurality of towers disposed in the rearward sealing portions of the cavities, said towers being coaxially mounted on the respective conductors and axially compressing the seal sleeves to force the terminals against forward shoulders in the cavities, each of said towers having a longitudinal slot which extends through the base whereby the conductors are laterally insertable into coaxial positions in the towers.

3. An electrical connector comprising:

a connector body having a plurality of longitudinal cavities which include rearward sealing portions having cylindrical walls, terminals disposed in the cavities and attached to conductors which extend out of the rearward sealing portions of the cavities, seal sleeves sealingly engaging the conductors and the cylindrical walls for sealing the conductor end of the electrical connector, and a conductor seal lock attached to the connector body, said conductor seal lock having a base, a plurality of towers disposed in the rearward sealing portions of the cavities and a shroud radially spaced from the towers and engaging the outside of the connector body so that an end portion of the connector body fits snuggly between the towers and the shroud, said towers being coaxially disposed on the conductors and axially compressing the seal sleeves to force the terminals against forward shoulders in the cavities, each of said towers having a longitudinal slot which extends through the base and said shroud having slots aligned with the longitudinal slots whereby the conductors are laterally insertable through the shroud and into the towers for coaxial dispositions therein.

* * * * *